US008092355B2

(12) United States Patent
Mortimer et al.

(10) Patent No.: US 8,092,355 B2
(45) Date of Patent: Jan. 10, 2012

(54) SYSTEM AND METHOD FOR VIBROTACTILE GUIDED MOTIONAL TRAINING

(76) Inventors: Bruce J. P. Mortimer, Maitland, FL (US); Karen L. Atkins, Celebration, FL (US); Gary A. Zets, Maitland, FL (US)

( * ) Notice: Subject to any disclaimer, the term of this patent is extended or adjusted under 35 U.S.C. 154(b) by 4 days.

(21) Appl. No.: 12/201,778

(22) Filed: Aug. 29, 2008

(65) Prior Publication Data

US 2009/0062092 A1 Mar. 5, 2009

Related U.S. Application Data

(60) Provisional application No. 60/966,997, filed on Sep. 1, 2007.

(51) Int. Cl.
*A63B 26/00* (2006.01)

(52) U.S. Cl. ..... 482/142; 482/148; 482/1

(58) Field of Classification Search ..... 482/142, 482/148, 1–9, 139, 140; 434/247
See application file for complete search history.

(56) References Cited

U.S. PATENT DOCUMENTS 4,685,448 A * 8/1987 Shames et al. ..... 600/23
4,738,269 A * 4/1988 Nashner ..... 600/595
5,303,715 A * 4/1994 Nashner et al. ..... 600/595
5,451,924 A * 9/1995 Massimino et al. ..... 340/407.1
5,476,103 A * 12/1995 Nahsner ..... 600/595
5,619,180 A * 4/1997 Massimino et al. ..... 340/407.1
5,919,149 A * 7/1999 Allum ..... 600/595
5,989,157 A * 11/1999 Walton ..... 482/4
6,063,046 A * 5/2000 Allum ..... 600/595
6,067,077 A * 5/2000 Martin et al. ..... 345/161
6,098,458 A * 8/2000 French et al. ..... 73/379.04
6,267,733 B1 * 7/2001 Peterson et al. ..... 600/587
6,389,883 B1 * 5/2002 Berme et al. ..... 73/65.01
6,409,685 B1 * 6/2002 Merzenich et al. ..... 600/587
6,422,869 B1 * 7/2002 Nagarajan et al. ..... 434/156
6,430,997 B1 * 8/2002 French et al. ..... 73/379.04
6,546,291 B2 * 4/2003 Merfeld et al. ..... 607/62
6,611,783 B2 * 8/2003 Kelly et al. ..... 702/150
6,632,158 B1 * 10/2003 Nashner ..... 482/8
6,682,351 B1 * 1/2004 Abraham-Fuchs et al. .. 434/247

(Continued)

OTHER PUBLICATIONS

Lewis M. Nashner and Gin McCollum, The organization of human postural movements: A formal basis and experimental synthesis, The Behavioral and Brain Sciences (1985) 8, 135-172.

(Continued)

*Primary Examiner* — Lori Baker

(74) *Attorney, Agent, or Firm* — Stephen C. Thomas; Robert A. Lynch; Hayworth, Chaney & Thomas, P.A.

(57) ABSTRACT

Motional training is achieved by providing a subject with vibrotactile feedback in response to an attempt by the subject to perform predetermined motions. In particular, an attempt by the subject to perform at least one predetermined motion is monitored using sensors, such as force plates or inertial sensors. The sensor signals indicate results of the attempt by the subject to perform the at least one predetermined motion, and a variance between the at least one predetermined motion and the results of the attempt by the subject to perform the at least one predetermined motion is determined. Vibrotactile signals are then sent to the subject by activating one or more actuators coupled to the subject, where the one or more actuators are spatially oriented with respect to the subject to indicate one or more directions. The vibrotactile signals indicate the variance with respect to the one or more directions.

7 Claims, 10 Drawing Sheets

U.S. PATENT DOCUMENTS

| | | | | |
|---|---|---|---|---|
| 6,749,432 | B2 * | 6/2004 | French et al. | 434/247 |
| 7,127,370 | B2 * | 10/2006 | Kelly et al. | 702/151 |
| 7,131,936 | B2 * | 11/2006 | Schlosser | 482/69 |
| 7,141,026 | B2 * | 11/2006 | Aminian et al. | 600/595 |
| 7,156,792 | B2 * | 1/2007 | Gibson-Horn | 482/148 |
| 7,335,172 | B2 * | 2/2008 | Laserow | 601/30 |
| 7,349,739 | B2 * | 3/2008 | Harry et al. | 607/49 |
| 7,492,268 | B2 * | 2/2009 | Ferguson et al. | 340/573.1 |
| 7,544,172 | B2 * | 6/2009 | Santos-Munne et al. | 601/5 |
| 2004/0173220 | A1 * | 9/2004 | Harry et al. | 128/892 |
| 2006/0015045 | A1 * | 1/2006 | Zets et al. | 601/78 |
| 2007/0203435 | A1 * | 8/2007 | Novak | 601/70 |
| 2008/0071314 | A1 * | 3/2008 | John | 607/2 |
| 2008/0077192 | A1 * | 3/2008 | Harry et al. | 607/48 |
| 2008/0195007 | A1 * | 8/2008 | Podrazhansky et al. | 601/47 |
| 2009/0005713 | A1 * | 1/2009 | Podrazhansky et al. | 601/2 |
| 2009/0023122 | A1 * | 1/2009 | Lieberman et al. | 434/258 |
| 2009/0062092 | A1 * | 3/2009 | Mortimer et al. | 482/142 |
| 2009/0187124 | A1 * | 7/2009 | Ludlow et al. | 601/47 |
| 2009/0234254 | A1 * | 9/2009 | Bar-Haim et al. | 601/29 |
| 2009/0270775 | A1 * | 10/2009 | Tommerdahl et al. | 601/70 |
| 2009/0272201 | A1 * | 11/2009 | Loeb et al. | 73/862.041 |

OTHER PUBLICATIONS

M. Igarashi, Vestibular and Visual Control on Posture and Locomotor Equilibrium, 7th International Symposium of the International Society of Posturography, Houston, Texas (1983).

Peter I. Terrence, J. Christopher Brill and Richard D. Gilson, Body Orientation and the Perception of Spatial Auditory and Tactile Cues, Proceedings of the Human Factors and Ergonomics Society 49th Annual Meeting (2005), pp. 1663-1667.

Arthur D. Kuo, An Optimal Control Model for Analyzing Human Postural Balance, IEEE Transactions on Biomedical Engineering, vol. 42, No. 1, Jan. 1995, pp. 87-101.

J. Christopher Brill, Peter I. Terrence, Joshua L. Downs, Richard D. Gilson, Peter A. Hancock and Mustapha Mouloua, Search Space Reduction Via Multi-Sensory Directional Cueing, Proceedings of the Human Factors and Ergonomics Society 49th Annual Meeting (2004), pp. 2134-2136.

Katherine Berg, Sharon Wood-Dauphinee, J.I. Williams and David Gayton, Measuring balance in the elderly: preliminary development of an instrument, Physiotherapy Canada, Nov./Dec. 1989, vol. 41, No. 6, pp. 304-311.

Patrick D. Roberts and Gin McCollum, Dynamics of the sit-to-stand movement, Biological Cybernetics Manuscript-Nr., R.S. Dow Neurological Sciences Institute, pp. 1-23, date unknown.

James L. Merlo, Shawn Stafford, Richard Gilson and P.A. Hancock, The effects of physiological stress on tactile communication, Tactile and Haptics/Operations and Research (THOR), University of Central Florida, 5 pages, date unknown.

Samer S. Hasan, Deborah W. Robin and Richard G. Shiavi, Drugs and Postural Sway, Quantifying Balance as a Tool to Measure Drug Effects, IEEE Engineering in Medicine and Biology, pp. 35-41, Dec. 1992.

P.I. Terrence, J.C. Brill and R.D. Gilson, Body Orientation and the Perception of Spatial Auditory and Tactile Cues, Proceedings of the 49th Annual Meeting of the Human Factors and Ergonomics Society, Orlando, FL, 2005.

Bruce J. Mortimer, Gary A. Zets and Roger W. Cholewiak, Vibrotactile transduction and transducers, J. Acoust. Soc. Am. vol. 121, No. 5, May 2007, Acoustical Society of America, pp. 2970-2977.

John Jeka, Kelvin Oie, Gregor Schoner, Tjeerd Dijkstra and Elaine Henson, Position and Velocity Coupling of Postural Sway to Somatosensory Drive, JN 79:1661-1674, 1998, Journal of Neurophysiology, Downloaded from jn.physiology.org on May 9, 2006.

Arthur D. Kuo, An optimal state estimation model of sensory integration in human postural balance, Department of Mechanical Engineering, University of Michigan, 2005 IOP Publishing Ltd., pp. S235-S249.

International Search Report for PCT/US08/74854, dated Nov. 12, 2008, 2 pages.

Written Opinion for PCT/US08/74854, dated Nov. 12, 2008, 6 pages.

* cited by examiner

SYSTEM AND METHOD FOR VIBROTACTILE GUIDED MOTIONAL TRAINING

CROSS REFERENCE TO RELATED APPLICATIONS

This application claims priority to U.S. Provisional Application No. 60/966,997, filed Sep. 1, 2007, the contents of which are incorporated herein by reference.

FIELD OF THE INVENTION

The present invention relates generally to systems and methods for providing a subject with motional training and, more particularly, to a system and method for providing motional training, such as treatment of disequilibrium and movement and balance disorders, by providing a subject with vibrotactile feedback in response to an attempt by the subject to perform predetermined motions.

BACKGROUND OF THE INVENTION

Balance, or a state of equilibrium, may be described as the ability to maintain the body's position over its base of support. In particular, the optimal posture for controlling balance typically requires maintaining the body's center of gravity (COG) within the base of support, such as the support frames defined by the soles. Balance may be divided into static balance and dynamic balance, depending on whether the base is stationary or moving.

Disequilibrium and movement and balance disorders can be debilitating and increase the potential for falls. A movement disorder is a condition that prevents normal movement. Some movement disorders are characterized by lack of movement, and while others are characterized by excessive movement. A balance control disorder is typically the result of sensory and/or motor disorders which impair equilibrium control by a subject. Balance control disorders may be bilateral, i.e., affect a subject on both left and right sides, or may only be manifested on one side. Movement and balance disorders may be caused by disorders in the vestibular, somatosensory, or central or peripheral nervous systems.

The vestibular system carries sensory information related to body equilibrium, specifically roll, pitch, and yaw motion oriented relative to the direction of gravity. Information is generated by the semicircular canals and maculae in the inner ear, relayed by the vestibular nerve to the brainstem vestibular nuclei, and processed by the vestibular nuclei and mid brain with corresponding muscular contraction and relaxation known as motor output.

Aspects of the somatosensory system include: 1) perception of pressure, vibration, and texture, i.e., discriminative touch, 2) perception of pain and temperature, and 3) proprioceptive sensation. Proprioception, which is often referred to more generally as the somatosensory system, involves awareness of movement derived from muscular, tendon, and joint articular surfaces provided by the peripheral nervous system and processed in the parietal lobe of the brain. These interoception senses provide internal feedback on the status of the body, indicating whether the body is moving with required effort and indicating where various parts of the body are located in relation to each other. Thus, proprioception involves the essential stimuli provided to, or received by, skin, joints, and/or muscles to maintain equilibrium or balance control.

Damage to any part of the central or peripheral nervous systems may interfere with balance control. Central nervous system processing includes the brain primary motor cortex responsible for generating the neural network impulses controlling execution of movement, the posterior parietal cortex responsible for transforming visual information into motor commands, the premotor cortex responsible for sensory guidance of movement and control of proximal and trunk muscles of the body, and the supplementary motor area responsible for planning and coordination of complex movements such as coordinated activity using two hands.

In particular, vision plays a significant role in balance. Indeed, up to twenty percent of the nerve fibers from the eyes interact with the vestibular system. A variety of visual dysfunctions can cause disequilibrium. These dysfunctions may be caused directly by problems in the eyes, or may be caused indirectly by disorders related to stroke, head injury, vestibular dysfunction, deconditioning, decompensation, or the like.

Meanwhile, the peripheral nervous system generally relates to the conduction of sensory information, or messages, from the peripheral nerves to the brain and spinal cord. For example, such sensory information may indicate that there is a pressure on the sole of a foot or that a toe is flexed. Sensory information may also indicate that the feet are cold or that a finger is burned. Peripheral neuropathy relates to defects in the peripheral nervous system. In general, damage to the peripheral nervous system interferes with the communication of messages to the brain and spinal cord.

Accordingly, the body relies on the interaction of several systems to control movement, balance, and posture. For example, the vestibular system in the ears orient upright stance, especially when the eyes are closed. The cutaneous, proprioceptive sensory system feels pressure under the feet. In addition, the joint and muscle spindles are sensitive to joint position and movement. Moreover, cognition or brain processing estimates the motor response magnitude. In sum, balance disorders are predominantly multi-causal with imbalance occurring due to deficits in more than one sensory, motor, neuro or cortical pathway.

The cause and extent of any deficits in a subject's movement and balance control may be determined by assessing the subject's ability to control movement and balance while performing a number of standard functional motor tasks, such as standing still, moving from a sitting position to a standing position, walking, walking on steps and uneven surfaces, or the like. This assessment may be achieved by manipulating sensory input and monitoring motor response. Quantified sensory assessment, for example, may examine touch-pressure, two-point discrimination, inner ear response to warm and cold, or visual acuity by reading the print on an eye chart. Diagnosis may also be determined qualitatively according to the observations by an examining physician or a physical therapist.

After a balance deficit has been diagnosed and quantified, a physician may prescribe remedial measures to try and bring the subject's balance control near or within normal limits. In certain instances, the physician may prescribe medication that reduces the action of peripheral senses on the brain or enhance neural network function. Alternatively, the physician may prescribe a course of physical therapy, which will typically last at least several months, with the object of training the subject's brain to deal with a reduced sense of balance when trying to maintain the body upright and prevent a fall. Normally, neither of these techniques will have an immediate effect on the subject's balance deficit. Moreover, medication can have side effects, and can also reduce the capability of the brain to process balance information from the peripheral senses. A traditional course of physical therapy requires a long training period which may extend over more than two months. These difficulties and limitations associated with conventional remedial measures for dealing with balance deficits are most problematic when the subject is older and likely to have a falling tendency.

SUMMARY OF THE INVENTION

In view of the foregoing, there is a need for a system and a method for rehabilitating disequilibrium and movement and balance disorders. Therefore, embodiments according to aspects of the present invention provide systems and methods for providing motional training, such as treatment of balance disorders, by providing a subject with vibrotactile feedback in response to an attempt by the subject to perform predetermined motions.

One embodiment provides a method for providing motional training to a subject, comprising: determining at least one predetermined motion for a subject to perform; monitoring an attempt by the subject to perform the at least one predetermined motion, the act of monitoring including receiving force-plate-sensor signals from one or more force plates, the subject being positioned on the one or more force plates while the subject attempts to perform the at least one predetermined motion, the force-plate-sensor signals indicating results of the attempt by the subject to perform the at least one predetermined motion; determining a variance between the at least one predetermined motion and the results of the attempt by the subject to perform the at least one predetermined motion; providing vibrotactile signals to the subject by activating one or more actuators coupled to the subject, the one or more actuators being spatially oriented with respect to the subject to indicate one or more directions, the vibrotactile signals indicating the variance with respect to the one or more directions; and training the subject according to the vibrotactile signals to minimize the variance while the subject performs the at least one predetermined motion. The act of monitoring may also include receiving inertial-sensor signals from one or more inertial sensors, the one or more inertial sensors being coupled to the subject while the subject attempts to perform the at least one predetermined motion, the inertial-sensor signals further indicating the results of the attempt by the subject to perform the at least one predetermined motion.

Another embodiment provides a system for providing motional training to a subject, comprising: one or more force plates that support a subject and provides force-plate-sensor signals while the subject performs at least one predetermined motion, the force-plate-sensor signals indicating the results of the attempt by the subject to perform the at least one predetermined motion; and one or more actuators that are configured to be coupled to the subject and that provide vibrotactile feedback to the subject indicating a variance, with respect to one or more directions, between the at least one predetermined motion and the results of the attempt by the subject to perform the at least one predetermined motion, the one or more actuators being spatially oriented with respect to the subject to indicate the one or more directions. The embodiment may further comprise one or more inertial sensors that are configured to be coupled to the subject and provide inertial-sensor signals while the subject performs the at least one predetermined motion, the inertial-sensor signals further indicating the results of the attempt by the subject to perform the at least one predetermined motion These and other aspects of the present invention will become more apparent from the following detailed description of the preferred embodiments of the present invention when viewed in conjunction with the accompanying drawings.

It is understood that although aspects of the present invention may be described with respect to the treatment of balance disorders, embodiments may be applied more generally to any type of motional training. It should also be evident that the systems and methods described herein may be used for non-medical activities such as sports, dance, or specific work task training.

DETAILED DESCRIPTION

Figure 1:
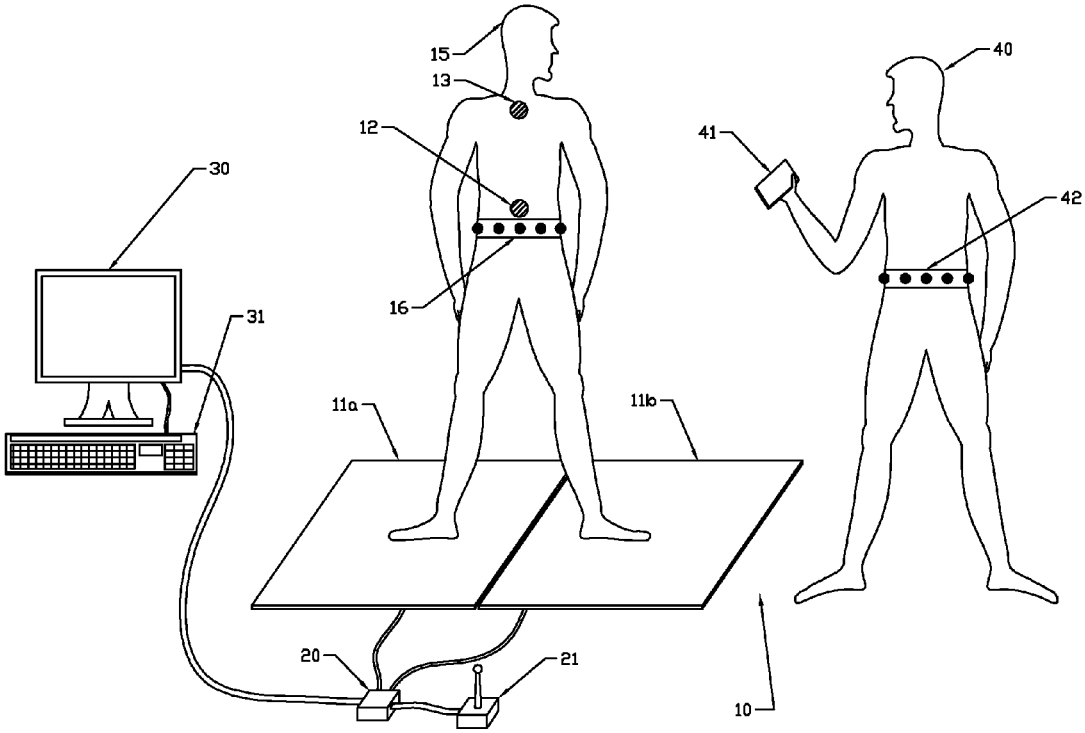
FIG. 1 illustrates an embodiment of a motional training system according to aspects of the present invention.

Embodiments according to aspects of the present invention provide systems and methods for providing a subject with motional training. In particular, embodiments provide motional training by providing a subject with vibrotactile feedback in response to an attempt by the subject to perform predetermined motions.

The set of predetermined motions may correspond to a functional task, while each predetermined motion corresponds to a sub-task. The act of moving from a sitting position to a standing position is a known and well documented functional task. Other examples include standing, reaching for an object, getting out of bed, and tasks related to gait.

The embodiments provide spatial orientation and/or timing feedback cues via a vibrotactile mechanism to guide postural and mobility decisions. Real time vibrotactile feedback may be provided to cue appropriate motions by the subject. In addition, such feedback may also be used to correct abnormal movement that can occur during functional tasks. Unlike the prior art, the embodiments recognize that sensory feedback requirements are context sensitive, and thus employ vibrotactile stimulation that may vary by type, location, duration, etc. to provide information that relates closely to each stage of a the functional activity. Thus, in some embodiments, the vibrotactile feedback is provided according to specific, and often well-understood, sub-tasks, thereby restricting the context and simplifying the control intelligence.

For example, the approaches to motional training described herein may be employed to treat balance disorders. Subjects with balance disorders may be trained to perform basic functional tasks and sub-tasks, so that the subjects learn balance strategies and retain the skills needed to prevent falls. In general, aspects of the present invention take advantage of the brain's ability to re-organize and re-learn the functional tasks and sub-tasks. Thus, embodiments provide a tool by which a subject and a therapist may determine the limits of stability and understand how the subject can learn/relearn functional tasks and sub-tasks.

In addition, embodiments allow such tasks to be scripted from a set of defined sub-tasks tailored to a subject. In other words, embodiments provide for the design of new tasks or the concatenation of different sub-tasks together to define more complex tasks. Of particular interest are functional activities that involve transitional motion, i.e., the change from one motional condition to another. For example, the sit-to-stand task includes several sub-tasks: sit, upper body lean, transition to upright stance, and steady upright stance. The sequence from one stage to the next is transitional and thus requires well bounded temporal (timing) and spatial (kinematical) conditions to be achieved.

Moreover, because the object of clinical treatment is the transfer of knowledge and experience to the subject during the treatment, embodiments facilitate dynamic modifications to accommodate the special needs of each subject and to adapt dynamically to challenge the subject to achieve new skill levels when the subject has mastered a certain tasks. This dynamic process is believed to be related to brain plasticity. Thus functional activities, after a training and evaluation period, may be repetitively practiced in a clinical setting using an environment that adaptively changes task difficulty as well as the number of tasks. Some embodiments also contemplate a take-home system that is programmed with the characteristics and requirements tailored to specific subjects, at a specific stage in their training or treatment, allowing subjects to continue balance training therapy in the home environment.

Referring now to FIG. 1, a motional training system 10 according to aspects of the present invention is illustrated. The motional training system 10 is operated by a therapist 40 to provide motional training for a subject 15. As described previously, in an example application, the motional training system 10 may be employed to treat balance disorders in the subject 15. As shown in FIG. 1, the subject 15 is situated on force plates 11*a* and 11*b*, while a vibrotactile feedback mechanism 16 as well as optional inertial sensors 12 and 13 are mounted on, or coupled to, the subject 15. Meanwhile, another vibrotactile feedback mechanism 42 may be mounted on the therapist 40.

In general, the motional training system 10 may be operated with an intelligent controller 20, which may be any processing device, such as a conventional desktop computer, that can execute programmed instructions provided on media, such as computer-readable memory. A visual display monitor 30 and a keyboard interface 31 may be connected to the intelligent controller 20 to provide a user interface. The therapist 40 may also operate aspects of the motional training system 10 via a remote interface 41 as shown in FIG. 1. The force plates 11*a* and 11*b*, the vibrotactile feedback mechanism 16, and the inertial sensors 12 and 13 may communicate with the intelligent controller 20 via conventional wired or wireless connections. For example, the force plates 11*a* and 11*b* may communicate directly to the intelligent controller 20 using a wired connection, such as a conventional universal serial bus (USB) connection or the like. Meanwhile, a wireless data connection 21, such as Bluetooth or the like, shown in FIG. 1 may allow the intelligent controller 20 to communicate with the vibrotactile feedback mechanism 16 and the inertial sensors 12 and 13. In addition, the remote interface device 41 may also use a wireless interface to connect to other components of the motional training system 10. In general, wireless communications may be particularly suitable for components of the motional training system 10 that must move easily with the subject 15 or the therapist 40.

The force plates 11*a* and 11*b* provide a technique for measuring body sway in terms of displacement of the center of foot pressure (COP), generated by the inherent instability of the subject 15 standing on the fixed support surface of the force plates 11*a* and 11*b*. The COP is computed from the signals provided by force transducers which are typically embedded in the corners the force plates 11*a* and 11*b*. The force transducer outputs are processed to obtain a projection of the resultant forces acting at the subject's center of gravity (COG) via the force plates 11*a* and 11*b*.

In general, a force plate is a sensor that measures the load at discrete points mounted beneath a relatively rigid plate. The load is usually measured using load-cell type sensors, converted into an electronic voltage signal and sampled using an analog to digital converter to be in a form suitable for computer or microcontroller processing. The response from one or multiple force plates can be combined using known analog to digital and mathematical algorithms implemented in computer software. The load cells and measurement conversion electronics in the embodiment of FIG. 1 may be configured to be accurate for a range of subject weights, for example from approximately 100 to approximately 300 pounds.

Although the embodiment of FIG. 1 illustrates two force plates 11*a* and 11*b* positioned adjacent to each other to form a combined area, any number and/or configuration of force plates may be employed to produce an active area that is sufficiently large to support the subject 15 while standing and/or performing predetermined motions as described further below. For example, the combined area of the force plates 11*a* and 11*b* may be greater than approximately 20 inches by approximately 11 inches.

Although the sensors used in some embodiments may be limited to the use of force plates 11*a* and 11*b*, the embodiment of FIG. 1 also employs the optional inertial sensors 12 and 13. As illustrated in FIG. 1, the inertial sensor 12 may be mounted proximate to the center of gravity (COG) of the subject 15, i.e., in the area of the lower back of the subject 15. The inertial sensor 12 may be mounted according to any suitable arrangement. For example, the inertial sensor 12 may be incorporated with a belt or garment worn by the subject 15. Alternatively, the inertial sensor 12 may be incorporated into the vibrotactile feedback mechanism 16 worn by the subject 15. Meanwhile, the inertial sensor 13 may be mounted higher on the upper body of the subject 12, for example at the back of the neck proximate to the top of the spine. The inertial sensor 13 may be incorporated in a garment or accessory worn by the subject 15. Accordingly, the inertial sensor 12 provides information regarding the orientation and motion of the COG, while the inertial sensor 13 second sensor provides information regarding the orientation and motion of the upper body of the subject 15.

Commercially available inertial sensors are typically provided with on-board intelligent processing, real-time signal filtering, and digital interfacing. In particular, each inertial sensor 12 or 13 may be a three-axis device that employs accelerometers and magnetometers. In some embodiments, the three-axis device may combine three-axis accelerometers with a magnetometer to provide a tilt sensor. In other embodiments, the three-axis device may employ gyroscopes to provide higher resolution than the tilt sensors, which are angular rate limited due to filtering and may be prone to drift.

The choice of sensor is based on the resolution and costs constraints. For example, the measurement of spine angle during a sit-to stand transition will require less resolution in clinical systems where the primary body orientation is measured using a force plate sensor. In this example, an accelerometer or low cost inertial device will provide sufficient accuracy for this task. However, for a stand-alone inertial sensor, a precision sensor (i.e. one that includes three axis accelerometers, gyroscopes and magnetometers) is preferably used.

There are some advantages is using multiple inertial sensors, particularly one mounted at the base of the spine and one just above the shoulder blades as shown in FIG. 1. Multiple sensors that are interconnected can be used to null some common mode errors are can be used to more accurately calculate the relative dynamic motion of the body trunk located between the sensors.

There are advantages to combining inertial sensors (or multiple inertial sensors) with a force plate as shown in FIG. 1, because a more accurate measurement of COG can be performed. Balance and specifically the limits of balance during dynamic activities (and especially large postural changes) will result in a significant mismatch between COG and COP. Trunk and or limb dynamic movement can be directly measured with an inertial sensor and used together with force plate data to obtain an accurate estimation of body orientation and dynamic motion.

In general, the motional training system includes one or more sensors that measure appropriate subject body orientation and approximate the location of the center of gravity. As described in detail below, sensor information is used together with knowledge of various functional activities to predict and compare the actual body response and posture during various stages of each particular functional task.

The selection of sensors may depend on whether the system is a clinical system or a more portable take-home system. In the clinical environment, a force plate or multiple force plate sensors is feasible.

Referring still to FIG. 1, the vibrotactile feedback mechanism 16 mounted on the subject 15 may include an arrangement of vibrotactile actuators as well as a controller and battery. Suitable vibrotactile actuators include the C-2 tactor and EM-200 actuators available from Engineering Acoustics Inc. (Casselberry, Fla.). The actuators are designed to be wearable on the body and may produce a strong displacement, i.e., vibration, within the frequency range of approximately 30 Hz to approximately 300 Hz. As such, the vibrotactile feedback mechanism 16 uses the sense of touch, i.e., the tactile sensory channel, as a technique for conveying information to the subject 15.

The sense of touch is processed via the somatosensory (SI) cortex in the brain. Various cutaneous sensory regions are mapped to different areas of the SI cortex, making the sense of touch both intuitive and implicitly linked to motion. In other words, the sense of touch is intrinsically linked with the neuro-motor channel, both at the reflex and higher cognitive regions, and is thus uniquely tied to orientation and localization.

Accordingly, the actuators of the vibrotactile feedback mechanism 16 are arranged and coupled to the subject 15, so that the actuators provide body-referenced, spatial information to the subject 15. In particular, a direction or motion is mapped to a specific vibrotactile actuator, so that activation of the specific vibrotactile actuator and its associated location provide information with respect to that particular direction or motion. Motion may be also conveyed with a vibrotactile feedback mechanism 16 by the sequential and timed activation of a series of vibrotactile actuators, two or more actuators being spatially oriented with respect to the subject, so that the associated location and movement of vibrotactile stimulus provide information with respect to that particular rate and movement direction.

It has been demonstrated that tactile cueing is significantly faster and more accurate than comparable spatial auditory cues and is stable across a variety of body orientations, even when spatial translation is required. The vibrotactile feedback mechanism 16 is therefore an intuitive, non-intrusive feedback mechanism that may be more preferable to visual and audio cueing. In addition, temporal information can also be conveyed through the actuators in the vibrotactile feedback mechanism 16.

The intelligent controller 20 can be operated to drive the vibrotactile feedback mechanism 16 to provide feedback to the subject 15 during motional training. This feedback may include spatially oriented and body-referenced information, temporal information, information based on sequences or patterns of pulses, as well as information based on vibration frequency. As described previously, the spatially oriented and body-referenced information may include directional information based on the location of the vibrotactile stimulus. The temporal information may be provided according to pulse timing, where more rapid pulses indicate a greater urgency. Information based on vibration frequency may be provided according to high and low frequencies which can be discerned by the subject 15, where frequencies of approximately 250 Hz may, for example, indicate a greater urgency and frequencies less than 120 Hz may indicate less urgency.

The therapist 40 may interface with the intelligent controller 20 via the screen display 30 and the keyboard 31. However, to make it easier for the therapist 40 to monitor and assist the subject 15 during the motional training, the therapist 40 may alternatively use the remote interface 41 to control aspects of the motional training system 10 as described further below.

In addition, because the vibrotactile feedback mechanism 16 provides information directly to the subject 15 undergoing motional training, the motional training system 10 may provide the therapist 40 with a similar vibrotactile feedback mechanism 42 as shown in FIG. 1. so that the therapist 40 can monitor the information that the subject 15 is receiving.

Figure 2:
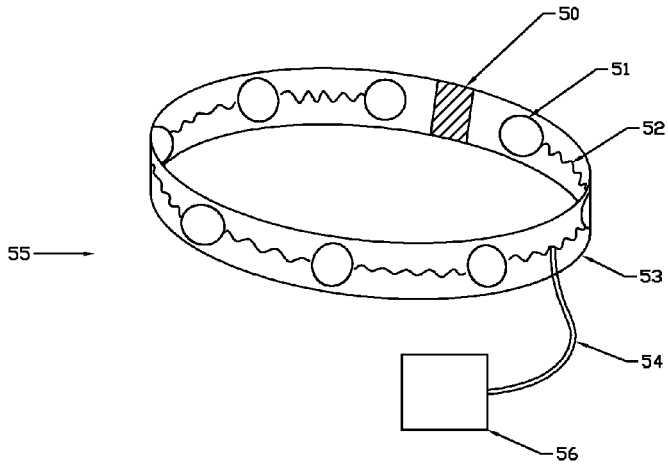
FIG. 2 illustrates an embodiment of a vibrotactile belt according to aspects of the present invention.

An embodiment of a vibrotactile feedback mechanism 16 is illustrated in FIG. 2 as a vibrotactile belt 55. The vibrotactile belt 55 may be worn around the torso by the subject 15 as shown in FIG. 1. The vibrotactile belt 55 includes a plurality of actuators 51 that are spaced equally around a band 53. As described previously, in one embodiment, the vibrotactile belt 55 employs an array of eight C-2 tactors available from Engineering Acoustics Inc. (Casselberry, Fla.). For example, eight actuators may be employed so that when the subject 15 wears the belt, one actuator 51 is centered on the front of the subject 15, e.g., aligned with the belly button. Correspondingly, another actuator 51 is aligned with the spine, another actuator 51 is aligned with the right side of the torso, and another actuator 51 is aligned with the left side of the torso. When the actuators 51 are oriented in this manner, each of the eight actuators 51 may represent a direction relative to the subject 15 similar to the eight major points on a compass, i.e., east, west, north, northeast, northwest, south, southeast, and southwest.

The vibrotactile belt 55, for example, may be formed with a band 53 of stretch fabric with a fastener 50, which may include a hook-and-loop fastener, button, zipper, clip, or the like. A wire 52 extends between each pair of actuators 51 and is of sufficient of length to allow the band 53 to stretch when worn by the subject 15. In particular, the wire 52 may be looped or coiled and mounted to the belt 55. The actuators 51 are connected to control electronics 56 via a wire harness 54. The control electronics 56 may include a microcontroller with analog to digital converters, circuitry for interfacing with sensors, digital-to-analog converters, and a series of amplifiers. The actuators 51 are optimized for exciting the tactile response by at the skin. In some embodiments, the actuators 51 are linear actuators.

This vibrotactile belt 55 may also employ additional sensors, such as direction sensors (not shown), which operate with the control electronics 56 and interface with the system intelligent controller 20, for example via the wireless data connection 21. Additional directional sensors may be used to determine the orientation of the subject 15 with respect to the force plates 11*a* and 11*b* to be used by the intelligent controller in motional tasks described hereinafter for the determination of vibrotactile feedback 16. Further, additional directional sensors may be used to determine the orientation of the subject with respect to the therapist 40 and to allow the vibrotactile feedback mechanism 42 on the therapist 40 to indicate the position of the vibrotactile feedback mechanism 16 on the subject. The position of the vibrotactile feedback mechanism 16 may be indicated to the therapist 40 in a format that is independent of or dependent on the orientation of the therapist 40.

Figure 3:
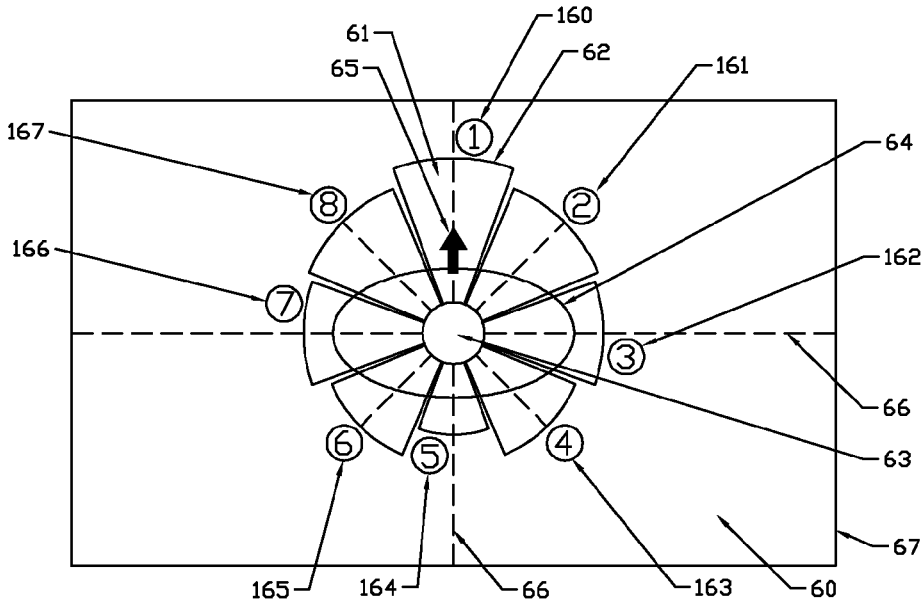
FIG. 3 illustrates an example of vibrotactile feedback that may be employed according to aspects of the present invention.

FIG. 3 illustrates a screen display 67 that may be shown by the intelligent controller 20 on the display monitor 30. The screen display 67 provides a view 60 that shows the center of pressure (COP) 63 of the subject 15 as determined via the force plates 11*a* and 11*b* or derived from combinational sensors. The view 60 also shows a training region that corresponds to an area in which the subject is expected to perform a predetermined motion as a part of motional training on the force plates 11*a* and 11*b*. Accordingly, the screen display 67 may be used to monitor activity by the subject 15 on the force plates 11*a* and 11*b*, and to provide visual feedback to complement the information provided by the vibrotactile feedback mechanism 16. In addition, the screen display 67 may be employed to set parameters or thresholds for operation of the vibrotactile feedback mechanism 16.

As FIG. 3 further illustrates, the view 60 also shows information relating to the vibrotactile feedback mechanism 16. In particular, the view 60 shows a series of eight segments, or zones, 61 around the perimeter of a representation 64 of the subject 15. The subject 15 is facing in a direction indicated by the arrow 65 in FIG. 3. Each segment 61 corresponds to an actuator 51 on the vibrotactile feedback mechanism 16. In the embodiment of FIG. 3, there are eight segments corresponding to eight actuators on the vibrotactile feedback mechanism 16. As described previously, the vibrotactile feedback mechanism 16 may be oriented so that one of the eight actuators 51 is centered on the front of the subject 15, another actuator 51 is aligned with the spine, another actuator 51 is aligned with the right side, and another actuator 51 is aligned with the left side. Therefore, the segment 160 shown in FIG. 3 may correspond with the actuator 51 on the front of the subject, the segment 164 may correspond with the actuator 51 aligned with the spine, and segments 162 and 166 correspond with the actuators 51 on the right and left sides, respectively. Each segment 61 includes an arc 62 that represents an adjustable threshold for each corresponding vibrotactile actuator 51. In other words, the width of the arc 62 as well as the length of the segment 61 may be configured to set thresholds that determine when the actuators 51 are activated to provide feedback. If, for example, the COP 63 of the subject 15 moves to a region beyond a segment 61 and arc 62, the corresponding vibrotactile actuator 51 may be activated. In other words, when there is a variance between the determined location of the COP 63, a vibrotactile actuator is activated. Similarly, in another example a vibrotactile actuator 51 may be activated until the COP 63 of the subject 15 moves to a corresponding region beyond a segment 61 and arc 62. Thus, the segments 61 and arc 62 may correspond to thresholds that define the boundaries for movement by the subject 15. The thresholds are selected so that information regarding movement of the subject relative to these thresholds provides useful information during motional therapy.

It is noted that movement of the COP 63 can be caused when the subject sways, and movement by foot or other significant movement is not required. As such, the example embodiment illustrated by FIG. 2 can assess static balance.

During an example operation of the motional training system 10, the subject 15 attempts to move according to one or more motions defined as a part of the motional training, e.g., moving from a sitting position to a standing position to test static balance. These predetermined motions may make up all or part of a functional activity. The force plates 11*a* and 11*b* react to the attempt by the subject 15 to move according to the predetermined motions. In particular, the force plates 11*a* and 11*b* determine corresponding movement of the COP 63 and communicate this information to the intelligent controller 20. As discussed previously, thresholds may be visually defined on the display monitor 30 via the intelligent controller 20 in terms of segments 61 and arcs 62. In one embodiment, if the intelligent controller 20 determines that the COP 63 has moved beyond any of the segments 61 and past any of arcs 62, the intelligent controller 20 activates the actuator 51 corresponding to the segment 61. Thus, the subject 15 receives a vibrotactile stimulus, or feedback, when there is a variance between the location of the COP 63 and the segments 61 and the arcs 62.

Before operation, the COP 63 is initially zeroed, or reset, to align the axes 66 and the segments 61 over the COP 63. However, the axes 66 may also be zeroed after a subset of the predetermined motions during the motional therapy. The therapist 40 may zero the axes 66 and segments 61, for example, via the therapist remote interface 41 while monitoring the subject's attempt to perform a set of predetermined motions. The motional training system 10 allows the subject 15 to sequentially move from one region to another according to the set of predetermined motions, e.g. from a sitting position to a standing position and so on. Zeroing allows to each region, i.e., a subset of the predetermined motions. Otherwise, the thresholds would only apply to the set of predetermined motions as a whole.

Figure 4:
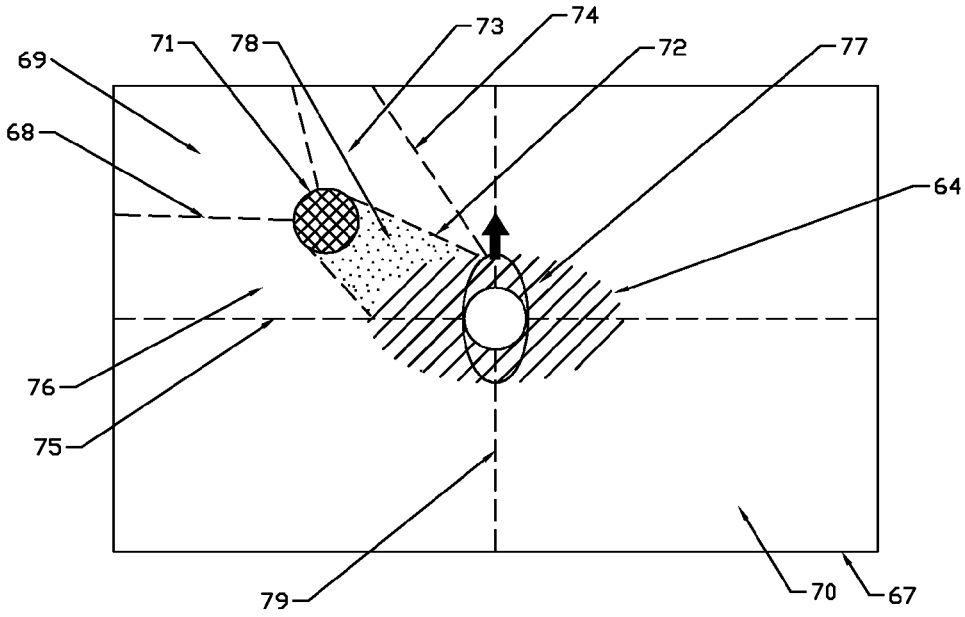
FIG. 4 illustrates another example of vibrotactile feedback that may be employed according to aspects of the present invention.

FIG. 4 illustrates another view 70 that may be provided on the screen display 67. The view 70 is also a top view that shows a representation 64 of the subject 15, a COP 77 of the subject 15, a target area 71, and navigation limits 72. The COP 77 is initially zeroed or reset to locate the axes 75 and 79 over the COP 77.

The predetermined motions corresponding to a functional activity may require the subject 15, and thus the COP 77, to move from one area to another. Accordingly, in some embodiments, vibrotactile cueing may be employed to guide the subject 15 to the specific target area 71. In particular, using the motional training system 10, the subject 15 is encouraged via vibrotactile cueing to move his COP 77 until it reaches the target zone area 71. Vibrotactile cueing may initially activate the actuator 51 that corresponds to the segment facing the target 71. The activation of that actuator 51 causes the subject to turn toward the target area 71. Movement to the target area 71 may require the COP 77 to traverse an intermediate zone 78. Vibrotactile pulses may be modulated to indicate the range to the target area 71. For example, the vibrotactile feedback with a frequency of 250 Hz and duration of 300 ms may be pulsed initially at 0.1 Hz, pulsed at 1 Hz in the intermediate zone 78, and then pulsed at 5 Hz when the target area 71 is reached. Alternatively, vibrotactile pulses may be modulated to indicate the rate at which the COP 77 is approaching the target area 71. For example, the vibrotactile feedback with a frequency of 250 Hz and duration of 300 ms may be pulsed initially at 0.1 Hz, pulsed at between 1 Hz and 5 Hz based on the rate of COP 77 movement during movement in the intermediate zone 78, and then pulsed at 5 Hz when the target area 71 is reached.

Directional or navigation feedback may also be provided to the subject 15 using adjacent actuators 51. For example, if the COP 77 shown in the view 70 moves off target, i.e., out of the intermediate segment 78, into the adjacent segment 73 defined between segments 72 and 74, the corresponding actuator 51 associated with the segment 73 may be pulsed at a low frequency 15 Hz amplitude modulation to indicate that the subject is off target. Alternatively, directional feedback can be provided by activating the actuator 51 that corresponds to the segment 76, which is the segment on the opposite side of the intermediate segment 78. In this case, the vibrotactile cueing is provided as a "tether" and signals the subject 15 to move in the direction of the vibrotactile stimulation. As shown in the view 70, the representation 64 of the subject 15 positioned in the segment 73 would be drawn back to the segment 78 as the representation 64 moves toward the segment 76 in response to the activation of the actuator 51 corresponding to segment 76.

Further vibrotactile feedback can be communicated to the subject 15 to indicate to the subject is that the target area 71 has been reached. This vibrotactile feedback, for example, may include pulsing two front actuators 51 alternately, and then pulsing one back actuator 51. The subject 15 may learn the various messages associated with the vibrotactile feedback before the start of the motional training.

Once the target 71 has been reached, the therapist 40 may also elect to move the axes 79 and 76 to the new location 71 and revert to the view 60 as shown in FIG. 3. Alternatively, the therapist may elect to guide the subject to a new target. Indeed the new target may be the initial starting position.

Embodiments of the present invention may be employed to treat stroke subjects with Pusher Syndrome. These subjects suffer from disturbed body orientation that drives both conscious perception of body orientation and abnormal muscle activation patterns or synergies. For example, subjects with Pusher Syndrome may perceive that their bodies are oriented in an upright position when in fact their bodies may be leaning by as much as 20 degrees towards the side of the brain lesion. When sitting or standing, the nonparetic extremities push lateral balance to the hemiparetic side. The phenomenon is present in approximately 79% of all acute strokes that resolves to 10% by 6 months (early intervention may eliminate Pusher Syndrome altogether), and is present in both left and right sided CVA. Subjects with Pusher Syndrome may have a normal perception of visual vertical, but they may be unable to perceive that their body posture may be leaning severely. Observations suggest that Pusher Syndrome affects the neurological pathway that is integral to sensing orientation of gravity and controlling upright body posture.

Treatment of subjects with Pusher Syndrome can be achieved by employing the vibrotactile feedback mechanism 16 to provide the subject a reference for body-orientation. If the subject shows a tendency to lean to a particular side, the length of the segment arc 62 corresponding to the opposite side is adjusted to be closer to the COP 63. The vibrotactile feedback mechanism 16 is set to activate the corresponding actuator 51 if the COP 63 moves over a particular segment arc 62. For example, if a subject leans to the right, segment 166 on the left side as shown in FIG. 3 is defined to provide a smaller threshold relative to the COP 63. In the normal maladapted stance, the subject feels vibrotactile feedback on the left side unless the subject leans further towards the right. The therapist can therefore use the invention to provide an additional sensory feedback reference which can be used for neurological retraining. A similar effect can be achieved using the technique described with reference to FIG. 4. In this case, a target 71 is configured on the left hand side of the subject, e.g., on axis 75, and used as a goal for the subject to shift their weight from the initial maladapted state 77 towards postural correction. In each example, the therapy may be practiced and repeated over several sessions, including various other tasks to enrich and diversify the learning environment. The therapist 40 may also adapt the segment thresholds and target locations in each of the examples, based on the subject performance during this task.

FIGS. 5*a*, 5*b*, 5*c* and 5*d* depict an example of a sequence of predetermined motions that define a functional transitional movement task. The transition from a sitting position to a standing is an extremely important functional activity. FIGS. 5*a*, 5*b*, 5*c* and 5*d* illustrate the sub-tasks that make up this functional task. The motional kinematics for this particular functional task are described by Patrick D. Roberts and Gin McCollum (Dynamics of the sit-to-stand movement, Biological Cybernetics, Volume 74, Number 2/January, 1996). This reference shows that some of the sub-tasks may be conditionally stable or unstable. The embodiment provides a technique for guiding the subject 80 through the sequence of sub-tasks and providing feedback to the subject 80 to help the subject 80 complete the functional task. The embodiment further provides a technique for repetitively guiding the subject 80 through a sub-activity to help the subject 80 learn the sub-activity.

Figure 5A:
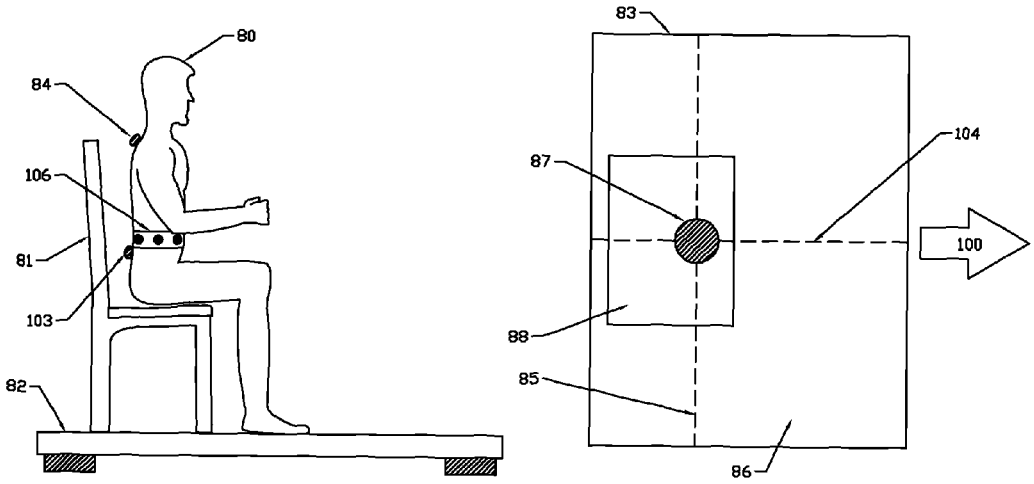
FIG. 5A illustrates a sub-task in a functional task that is the subject of motional training according to aspects of the present invention.

FIG. 5*a* shows a subject 80 initially at rest in a sitting position on a chair 81 disposed on a force plate 82. The subject wears a vibrotactile belt 106 around his torso. An inertial sensor 103 may be mounted at the lower back of the subject 80 and an inertial sensor 84 may be mounted at the upper shoulder of the subject 80 to provide additional information. Specifically, the spine angle, bend and other postural information from the inertial sensors 103 and 84 may be helpful in determining subject transitional motion characteristics.

FIG. 5*a* also shows a corresponding top view 83 of the force plate area. The view 83 may also be shown as a screen display on the display monitor 30, and may be used by the therapist 40 to monitor activity and/or configure a training region. In addition, the view 83 may provide visual feedback that complements the vibrotactile feedback received by the subject 80. The subject is orientated to face in the direction shown by arrow 100. The chair takes up an area 88. While seated, the subject COP 87 is located within the chair area 88. System axes 104 and 85 are initially defined to coincide with a static stable seating. It should be noted that the COP data and vibrotactile belt 106 can easily be used to provide the subject 80 with postural feedback while seated. If the COP 87 moves outside a predefined segment, i.e., a variance occurs, the corresponding body referenced tactile transducer can be used to alert the subject 80 to correct his or her posture. In this case, the limits of the segment need to be close to the axes 85 and 104 as the excursion of a subject's COP 87 during sitting is relatively small.

Figure 5B:
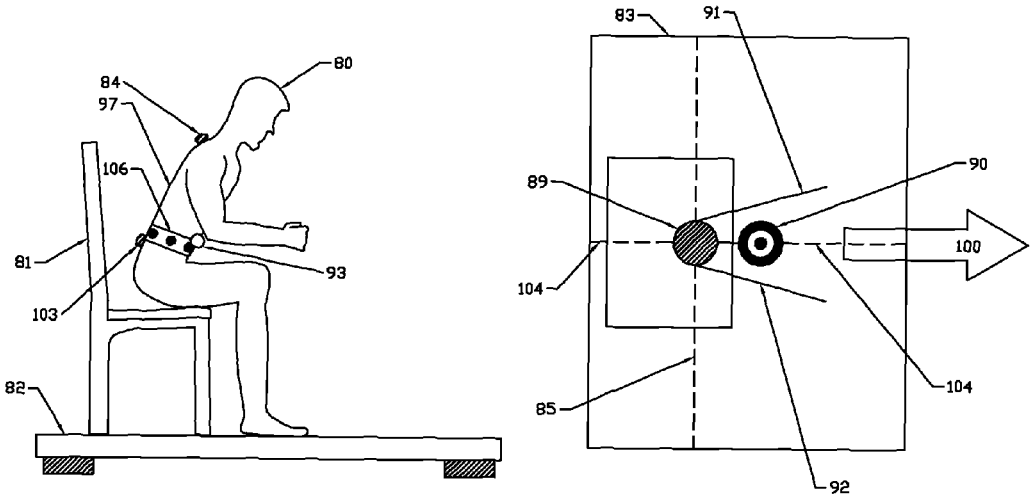
FIG. 5B illustrates another sub-task in the functional task of FIG. 5A.

FIG. 5*b* shows the next sub-task in the sequence. In particular, the subject 80 moves from the sitting position on a chair 81 to an upper body forward lean position 97. The subject 80 is guided into the lean position 97 by the intelligent controller 20 based on measurement of the patient 80 COP 87 and sensor information. In particular, the intelligent controller 20 may provide vibrotactile cueing by activating the actuator of positioned at the front of the subject 80.

FIG. 5*b* shows a corresponding top view 83 of the force plate area. The subject 80 is orientated to face in the direction shown by arrow 100. The COP 89 of the subject 80 is shown with axes 85 and 104. It is desirable to guide or cue the subject 80 to move his COP 89 onto a target area 90. During the process of translating the COP 89 towards the target area 90, it is also desirable that the COP 89 stay within moving bounds 91 and 92. If the COP moves outside the bounds 91, vibrotactile feedback is then applied to the subject to correct the translation. The target region 90 may be set to shapes other than a circle, such as a rectangle, and may be positioned off the axis 104 to counter any subject asymmetrical tendencies.

Figure 5C:
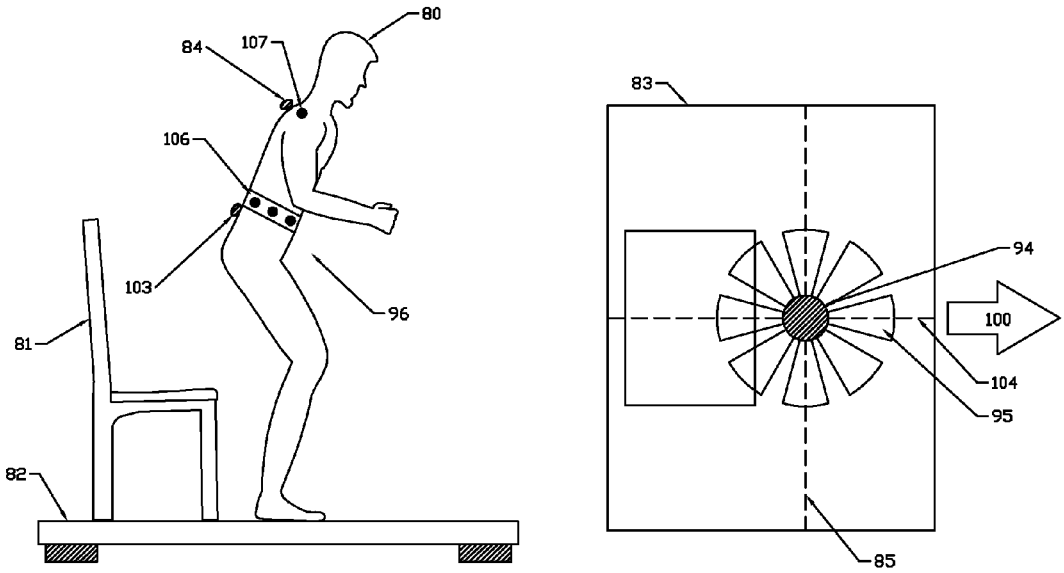
FIG. 5C illustrates a further sub-task in the functional task of FIG. 5A.

FIG. 5*c* shows the next further sub-task in the sequence. In particular, the subject 80 transitions to an initial stance 96 after moving from a sitting position on the chair 81. An additional vibrotactile feedback mechanism 107 may be mounted on the subject's upper body. Lean is no longer encouraged and the subject 80 is guided to a stable balance by the intelligent controller 20 by providing vibrotactile cueing. The subject 80 is also guided to regain upright posture. The sensors 84 and 103 may be used to determine the spine trunk lean angle and provide this information to the intelligent controller 20. The controller 20 then provides vibrotactile feedback 106, preferably via a pattern of vibrotactile signals representing a message. Alternately an additional vibrotactile feedback 107 can be used to provide directional cueing i.e. a vibrotactile stimulus on the neck, shoulders or upper body to guide the subject 80 to move towards the stimulus and regain upright stance. A tactile message is thus a reminder to the subject 80 and eliminates the need for a verbal instruction.

FIG. 5*c* shows a view 83 of the force plate area. The subject is orientated to face in the direction shown by arrow 100. The COP 94 is aligned with axes 104 and 85. When compared to the initial position of the axes shown in FIG. 5*a*, these axes have shifted in the direction of the arrow 100. Vibrotactile feedback can be applied to the subject 80 according to the technique described with reference to FIG. 3. Various segments 95 represent areas beyond which a body referenced vibrotactile signal is applied to indicate to the subject that the threshold has been exceeded in a particular zone, i.e., a variance has been created.

Figure 5D:
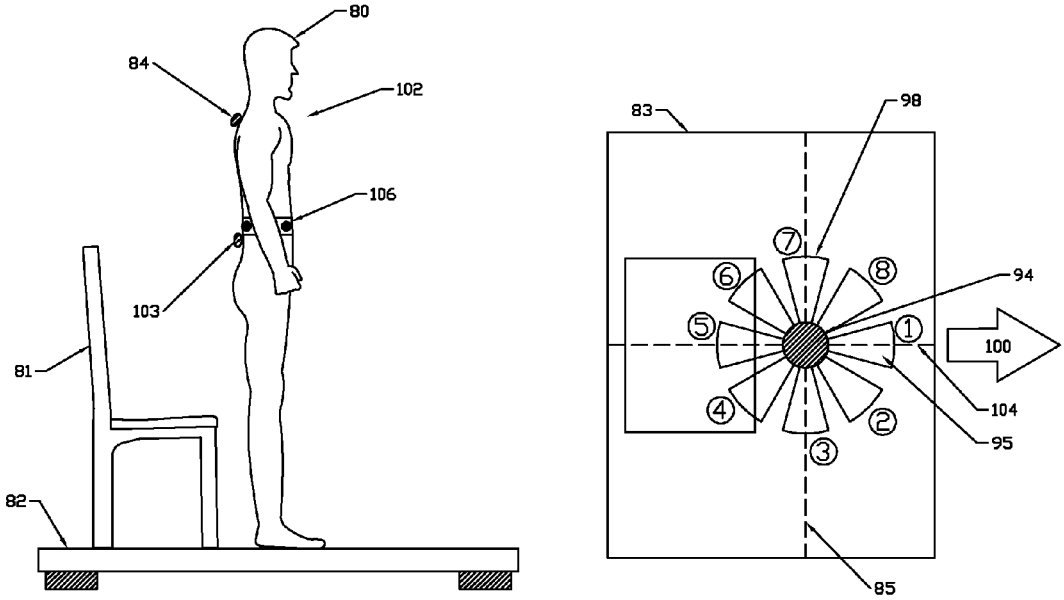
FIG. 5D illustrates yet another sub-task in the functional task of FIG. 5A.

FIG. 5*d* shows the subject 80 who has attained an upright stance 102. The forward lean no longer exists and the subject 80 is now be assisted in quiet stance. The intelligent controller 20 provides vibrotactile cueing 98 when the COP 94 moves beyond the defined thresholds. The inertial sensors 84 and 103 may be employed to confirm spine angle. The inertial sensor 84 may also provide heading (or trajectory) information to the intelligent controller 20 and provide corrective feedback if the subject is not facing in the direction of the arrow 100.

FIG. 5*d* also shows a corresponding view 83 of the force plate area. The subject faces in the direction shown by arrow 100. The axes 85 and 104 coincide with the initial location of the COP 94. Similar to view 60 of FIG. 3, the view 83 shows a series of segments 95 that indicate the thresholds for movement of the COP 94 and determine when the appropriate vibrotactile actuator is activated.

Figure 5E:
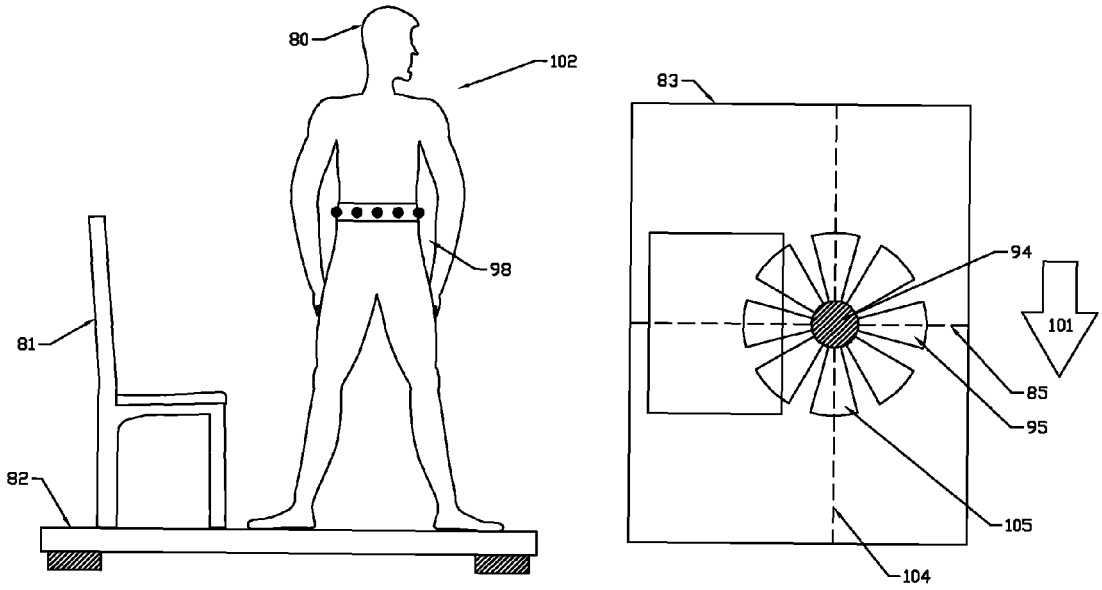

FIG. 5*e* illustrates another sub-task in the sit-to stand functional task. After completing the sub-tasks described previously, the subject 80 now performs a full body turn to the right and resumes a stable stance. The subject 80 is guided through a turn to the right through vibrotactile cueing. In particular, one or more actuators on the right side of the subject 80 are activated to initiate a turn to the right. The inertial sensor 103 may provide heading data to the intelligent controller 20.

FIG. 5*e* also shows the corresponding view 83 of the force plate area. The subject faces in the direction shown by arrow 101. The vibrotactile belt 98 is orientated in the direction that the subject is facing, so that the front segment now corresponds with the segment 105 shown in the view 84. Similar to the view 60 of FIG. 3, the view 83 shows a series of segments 95 that also indicate the thresholds for movement of the COP 94 and determine when the appropriate vibrotactile actuator is activated.

Figure 6A:
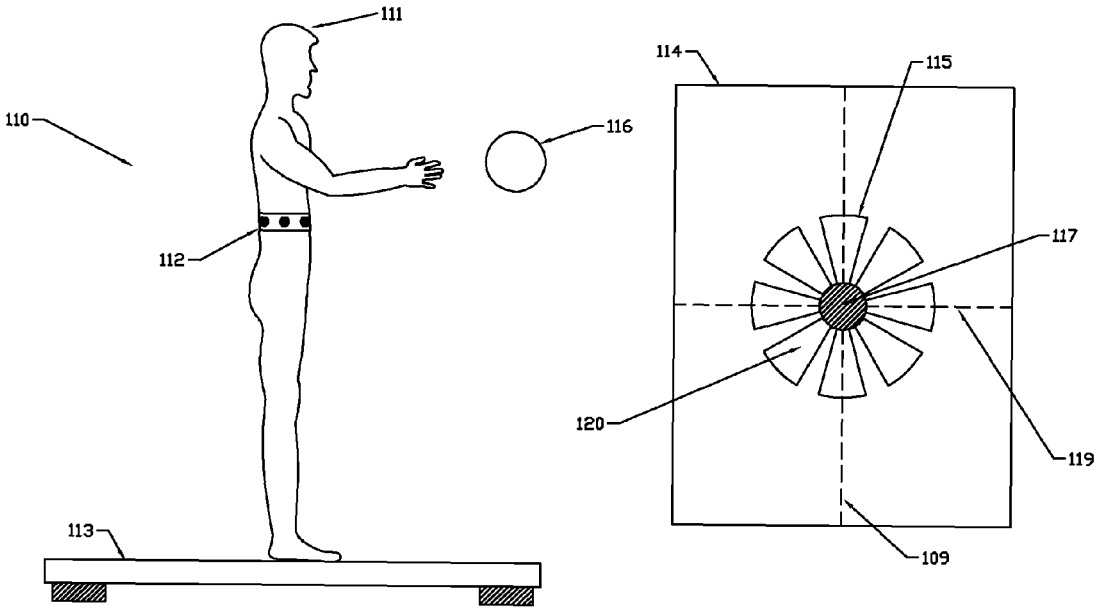
FIG. 6A illustrates a sub-task in a functional task that is the subject of motional training according to aspects of the present invention.

Referring now to FIG. 6*a*, an example of a functional task 110 is illustrated where a subject 111 stands on a force plate 113 and reaches for a target object 116. The vibrotactile belt 112 provides feedback to guide the subject 111 through the task 111. The corresponding top view 114 also shown in FIG. 6*a* is similar to the view 60 of FIG. 3. The view 114 shows a series of segments 120 that indicate the thresholds for movement of the COP 120 and determine when the appropriate vibrotactile actuator is activated. Alternatively, the view 114 may be employed to provide vibrotactile cueing which guides the subject 111 through the necessary sub-task movements with the vibrotactile belt 112.

Figure 6B:
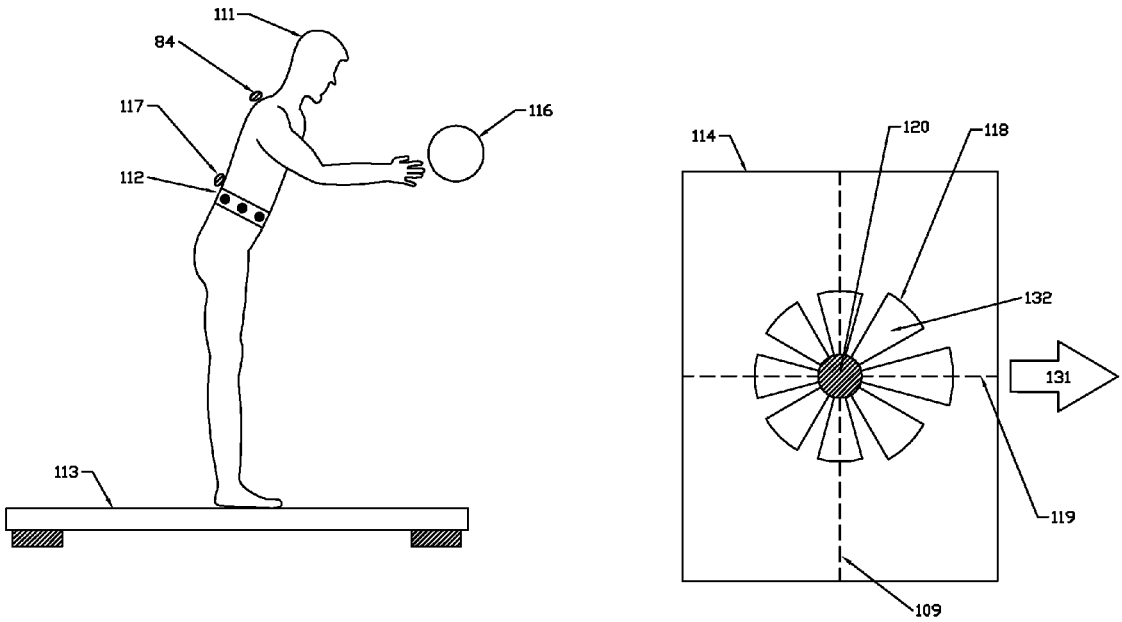
FIG. 6B illustrates another sub-task in the functional task of FIG. 5A.

FIG. 6*b* illustrates the subject 111 reaching for the target object 116 while standing on a force plate 113. Inertial sensors 117 and 130 may provide additional information about bend angle and posture. An intelligent controller 20 uses the force plate 113 and sensor information to provide sub-task specific vibrotactile feedback to the subject 111 with the vibrotactile belt 112.

FIG. 6*b* also shows the corresponding top view 114 with the subject 111 facing in direction 131. Similar to the view 60 of FIG. 3, a series of segments 132 indicate the thresholds for movement of the COP 120 and determine when the appropriate vibrotactile actuator is activated.

Figure 7A:
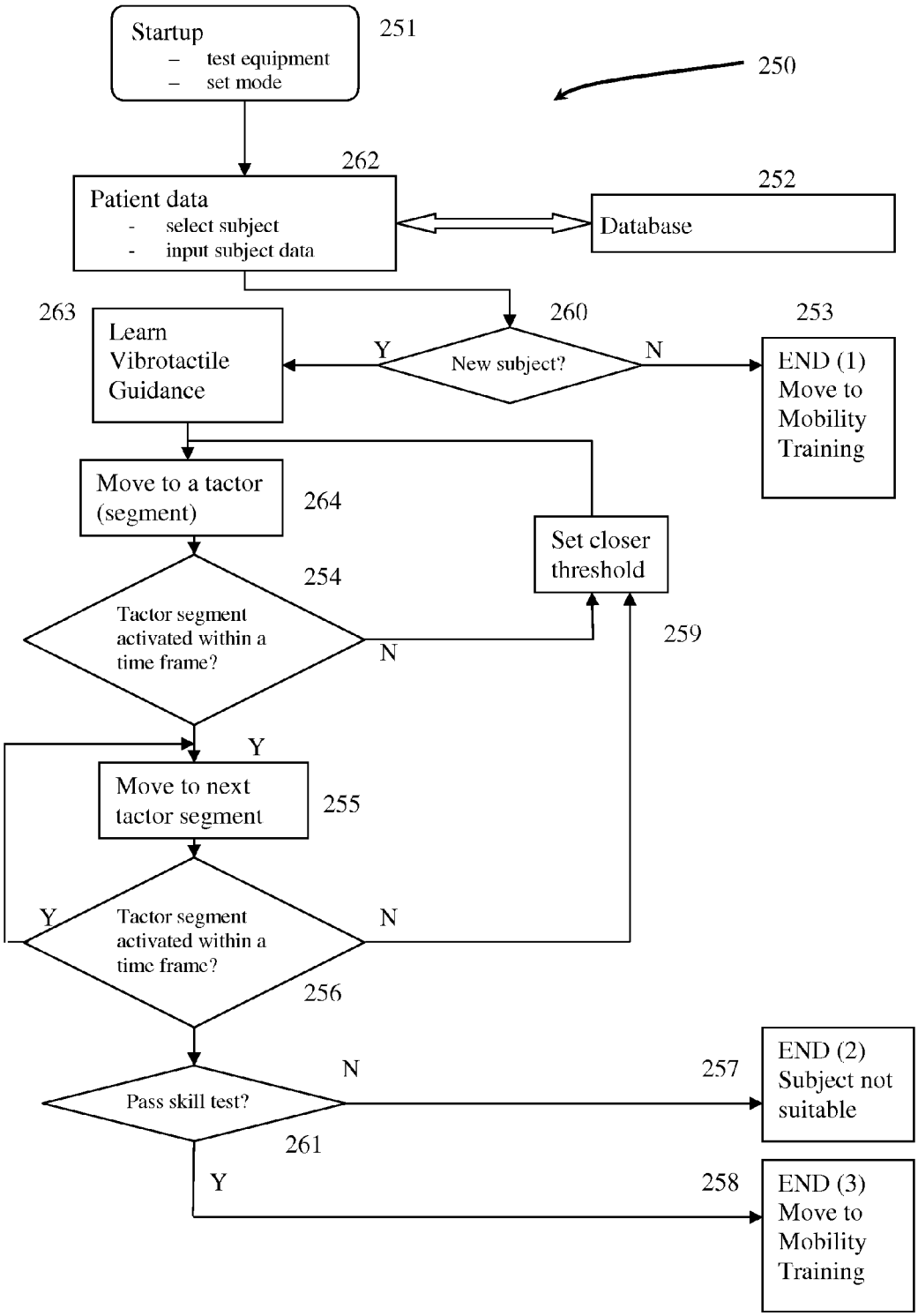
FIG. 7A illustrates program flow and system logic for motional training according to aspects of the present invention.
Figure 7B:
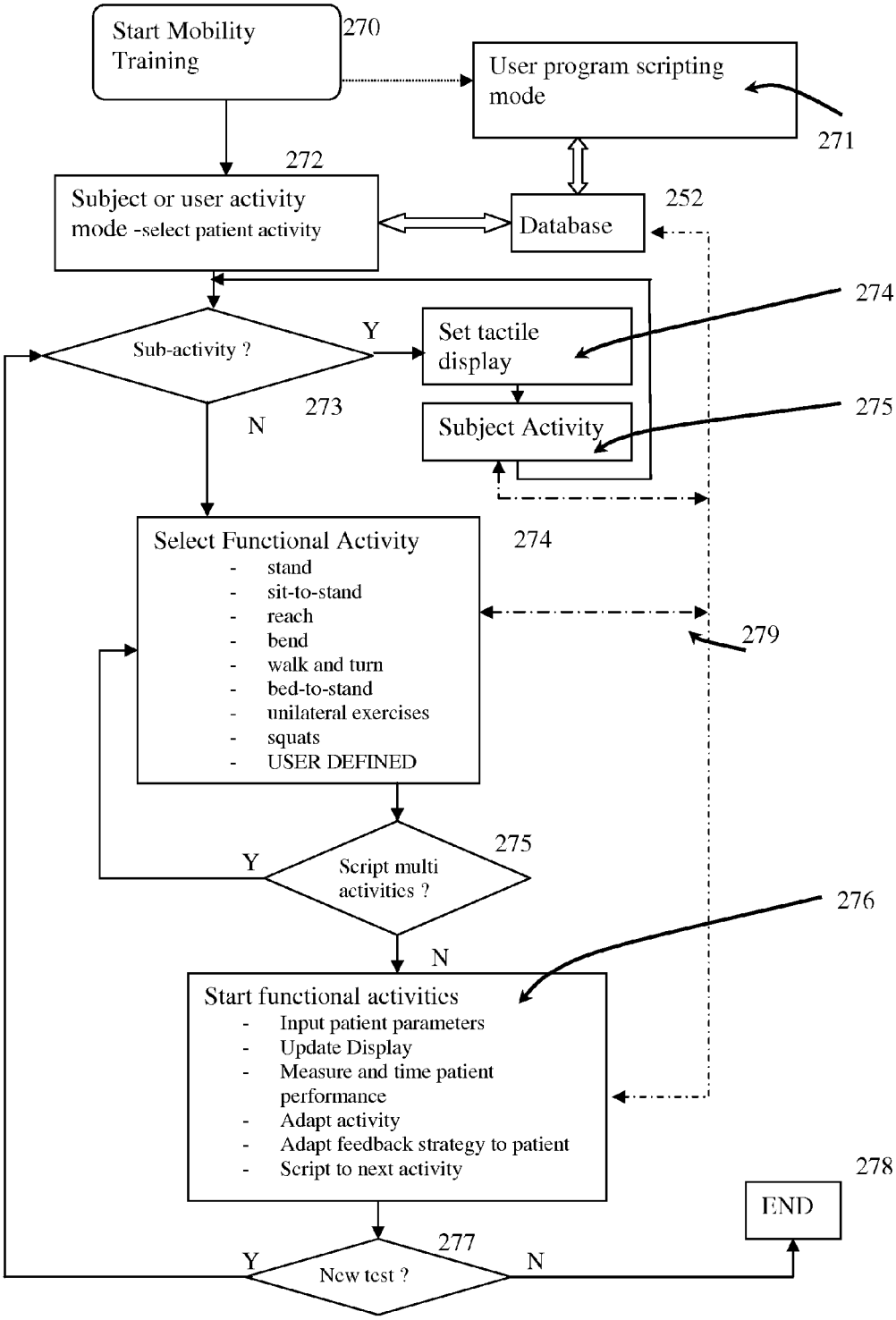
FIG. 7B illustrates another program flow and system logic for motional training according to aspects of the present invention
Figure 7C:
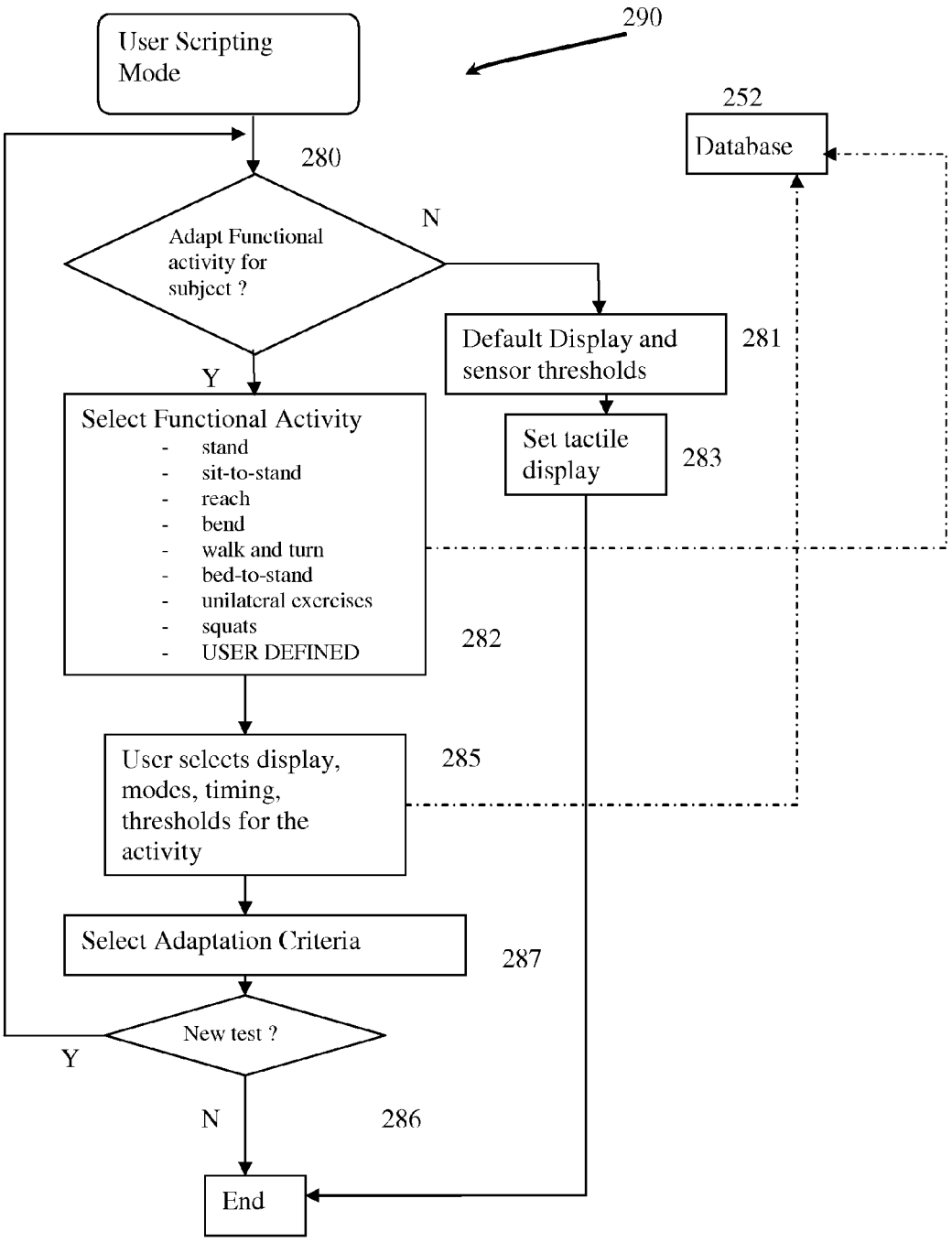
FIG. 7C illustrates further program flow and system logic for the motional training according to aspects of the present invention

FIGS. 7*a*, 7*b*, and 7*c* show program flow and system logic for the motional training system 10. The program flow includes three main routines; a test shown in FIG. 7*a* for new subjects to determine whether they will be suitable candidates for vibrotactile guided training, a scripting routine, and configuration tool for therapists trainers to design their own functional movement tasks as shown in FIG. 7*c* and a series of functional movement tasks as shown in FIG. 7*b*. The functional tasks 274 include tasks and sub-tasks, sensor measurements, processing, visual and vibrotactile feedback data, adaptive changes to the tasks and feedback parameters, database storage, and retrieval of information. A feature in the operation of the program and system is the ability to adapt the task for the subject and also adapt the vibrotactile thresholds and feedback. These adaptations are completed automatically by the system using an assessment of the subject performance in the task.

FIG. 7*a* illustrates the program control logic for a test 250 and a start-up step 251 for the determination of subject or user suitability for vibrotactile guided motional training. Subject data is either selected or entered at step 262. A database 252 is employed to store, retrieve and collect subject information as well as specific components and data related to vibrotactile guided motional training activities. New subjects undergo initial training at step 263, e.g., a therapist shows the subject how the vibrotactile actuators activated during movement by the subject. In particular, the segment thresholds as described previously are set to cause activation of particular actuators when the subject moves his COP in a corresponding direction for defined distances or thresholds as described hereinbefore. The subject is instructed, for example, to lean to the side and activate a corresponding vibrotactile actuator in step 264. If the subject fails to comply or is unable to reach the threshold to activate the particular actuator within a time threshold 254, e.g., approximately about 5 seconds, the system may alert the therapist and move the threshold for activation closer to the COP. The time threshold may be normalized for subject age and ability. If the subject is able to activate the particular actuator, however, the subject is then instructed to move and activate another actuator in step 255. Each subsequent activation of a particular vibrotactile actuator should also be activated within a similar time threshold 256, to that set during the initial movement test 254. If the subject fails to activate 50% of the actuators, for example, at a default threshold 261, the system may determine in step 257 that the subject is not suitable for vibrotactile guided training. Subjects who are able to show sufficient competence may move onto other functional tasks in step 258.

FIG. 7*b* shows the program control logic for vibrotactile guided motional training 270. The therapist may employ two modes: a program scripting mode 271 and a subject activity mode 272. The program scripting mode 271 allows the therapist to configure and program new functional tasks that are stored in a system database 252. The subject activity mode 272 may use this database 252. Vibrotactile guided motional training may include sub-tasks 273, which may be defined according to the types of vibrotactile feedback techniques described with reference to FIG. 3 or 4. The particular vibrotactile feedback mode and sub-task 273 may be chosen by the therapist for subject task activity 275. Sub-task vibrotactile guided training is completed to ensure that the subject masters and practices the necessary mobility skills for functional tasks. The definitions of the functional tasks and sub-tasks, together with subject data, and user defined parameters are stored in a system database 252 and may be accessed 279 for the selection of a functional task 274. The system also permits multiple tasks 275 to be concatenated to create more complex functional task sequences. Once the task 274 and task combination have been selected, the functional activities are commenced 276. Depending on the activity the therapist may adjust various parameters for task or sub-task performance based on a visual assessment of the subject. For example, the therapist may change a threshold to encourage a subject to lean in a reach task. In other embodiments, the functional activity may be programmed to automatically adapt based on the context and performance of the subject in a particular set of tasks. Activities may be repeated 277 until completion 278. The performance of the subject during the functional activities may be stored for later evaluation and assessment in database 252.

FIG. 7*c* illustrates the program control logic for defining and scripting motional tasks 290. The sensor thresholds as well as the vibrotactile feedback may be configured by the user or therapist for a particular activity or adapted for the specific needs of a subject. In multiple or complex tasks, the display may migrate from one mode to another as described hereinbefore. Tasks can be either set to default 281 or programmed to therapist defined parameters 285. The functional tasks can be chosen from a menu of standard activities 282 or be user defined 285. Multiple tasks may be concatenated and stored in the database 252. In user selected functional activity scripting, it may also be further desirable to select 285 timing, temporal, vibrotactile and display. Further, adaptation of the vibrotactile, display and timing thresholds may be selected 287. Adaptation criteria may be based on the subject's performance during the scripted motional activities and the subject achieving user defined metrics. For example, the predefined sensitivity thresholds for a functional activity, such as that described in FIG. 3, can be adapted at a user determined rate, based on how quickly and how often a vibrotactile display threshold is reached.

Figure 8:
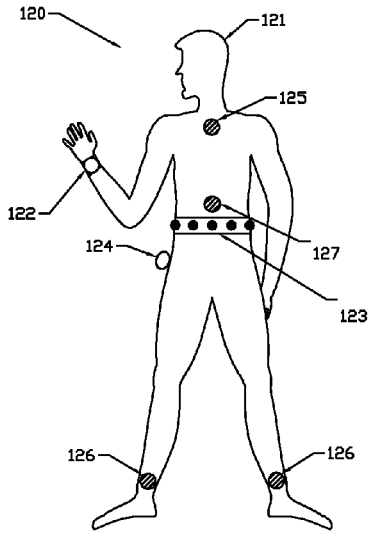
FIG. 8 illustrates another embodiment of a motional training system according to aspects of the present invention.

FIG. 8 shows a motional training system 120 on a subject 121. Sensors 125, 126 and 127 may be used to provide postural and gait information to an intelligent controller 124. The user can select various functional tasks and program modes via a wrist display 122 or in an alternate embodiment, the intelligent controller 124 may preempt the subject and recognize a limited set of functional activities. Sensor signal gesture recognition algorithms can be used for this purpose. User assistance during dynamic tasks is provided by a vibrotactile belt 123, controlled by the intelligent controller 124. In another embodiment of this invention, the transitional motion assistive device 120 may be configured with limited sensors or even without sensors. In this configuration the activities are cued in open loop i.e. the system acts to provide subject specific temporal, body referenced cues. In all embodiments, it is anticipated that the therapist programs subject specific parameters into the intelligent controller 124.

Figure 9:
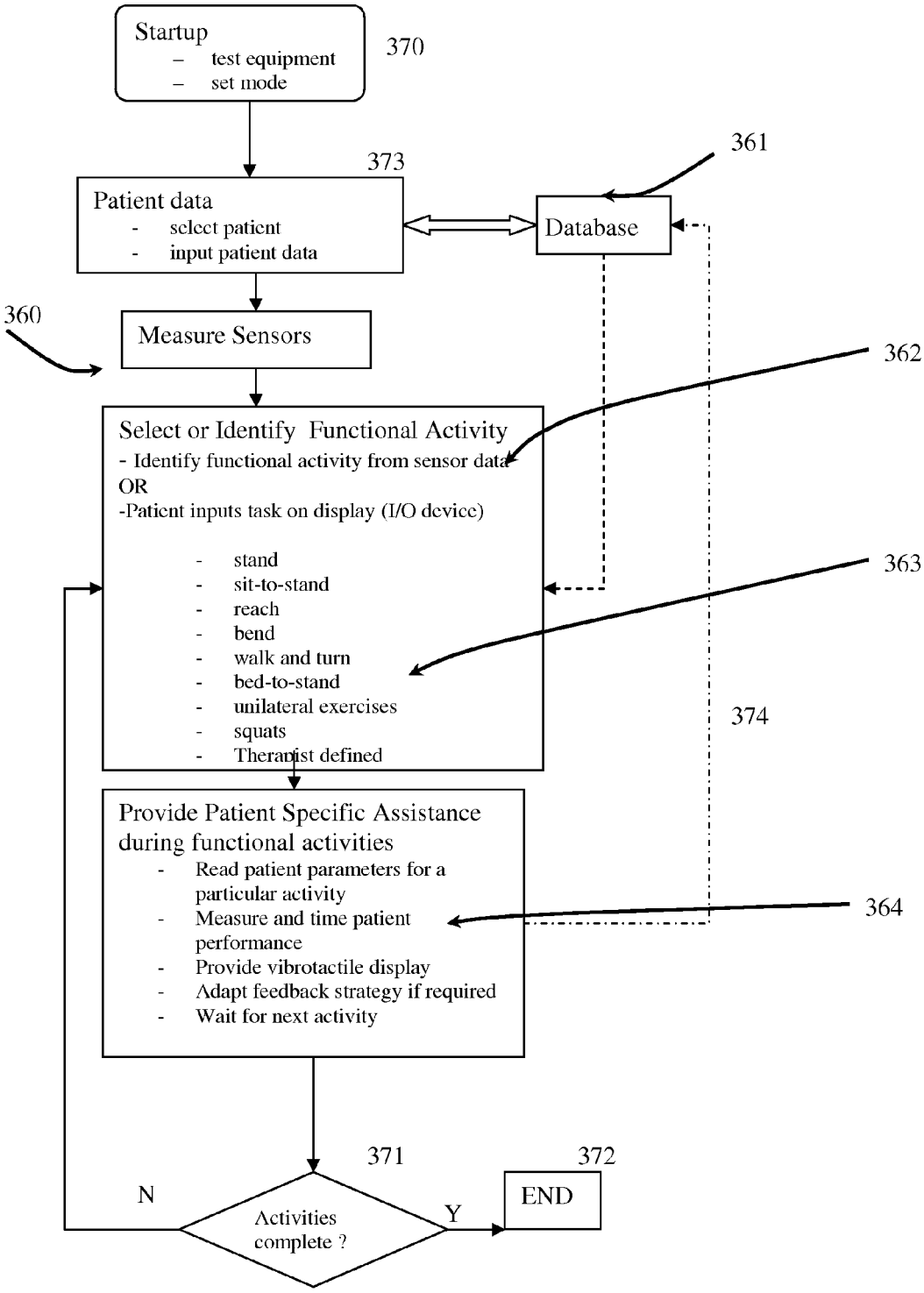
FIG. 9 illustrates an embodiment of a program flow for motional training according to aspects of the present invention.

FIG. 9 shows a program flow diagram 370 for motional training. The program flow includes the step 360 of measuring a suite of sensors to obtain body kinematics information, for example COP and COG. A database 361 is pre-programmed to contain subject data and subject specific parameters, such as timing data, subject needs, specific cueing information, adaptation and vibrotactile thresholds. The database 361 may also contain a set of gesture recognition parameters that are associated with a particular subject's movement parameters during previous motional activities. Subject functional movement tasks 362 may be either automatically recognized by the movement patterns determined from the sensor measurements 360 using the intelligent processor, or input by the subject or therapist using an interface device, for example a remote interface device 41 or wrist display 122 as described hereinbefore. Thus, the system knows what task 363, e.g., sit-to-stand, reach, walk and turn, or other predefined task, is being performed. The therapist enters subject specific parameters 373 into the database 361. The system thus uses the subject specific parameters stored in the database 361 to determine vibrotactile feedback display parameters. Vibrotactile guided motional assistance during specific tasks provided 364. The subject's performance during the functional activity tasks may also be measured and stored 374 in the database 361, allowing adaptive re-programming of the assistive steps as well as a record of subject compliance with the established protocols. Analysis of the database can be performed in real time by the therapist, or stored for subsequent downloading. Downloading and analysis may also be completed remotely using the internet and related approaches.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. A method for providing motional training to a subject, comprising:

(a) providing at least one force plate having a sensor;

(b) positioning a subject on said at least one force plate;

(c) identifying a predetermined task for the subject to perform while positioned on said at least one force plate, said predetermined task being defined by one or more parameters;

(d) receiving signals produced by said sensor in response to an attempt by the subject to perform said predetermined task; and (e) providing vibrotactile stimulation to the subject in the event of a variance between said signals and the parameters defining said predetermined task, said vibrotactile stimulation being applied at one or more locations on the subject to induce one or more movements on the part of the subject in one or more directions in order to counteract said variance.

2. The method of claim 1 in which step (a) comprises providing at least one substantially rigid force sensor plate having a load cell mounted at each corner.

3. The method of claim 1 in which step (a) comprises identifying a task which includes at least one of sitting, standing, reaching, bending, walking, turning and correcting a sway of the body of the subject in any direction.

4. The method of claim 1 in which step (e) compares providing a number of vibrotactile actuators coupled to the subject, each of said vibrotactile actuators being effective to produce a vibrotactile stimulation at a different location on the subject.

5. The method of claim 4 in which step (c) compares defining said parameters by associating a discrete area on said at least one force plate with each of said number of vibrotactile sensors.

6. The method of claim 5 in which step (d) comprises producing said signals in the event the center of pressure of the subject moves outside of any said discrete areas on said at least one force plate.

7. The method of claim 6 in which step (e) comprises providing vibrotactile stimulation from each of said vibrotactile sensors associated with those discrete areas where movement of the center of pressure of the subject occurs outside of such discrete areas.

* * * * *